United States Patent [19]

Roberts et al.

[11] 4,055,116

[45] Oct. 25, 1977

[54] COUNTING AND PRINTING MECHANISM WITH INTERCHANGEABLE UNIT PRINTER WHEEL

[75] Inventors: Arnold E. Roberts; Jack D. Harshman, both of Statesboro, Ga.

[73] Assignee: Emerson Electric Co., St. Louis, Mo.

[21] Appl. No.: 658,485

[22] Filed: Feb. 17, 1976

[51] Int. Cl.[2] ..... B41L 45/00

[52] U.S. Cl. ..... 101/79; 101/72

[58] Field of Search ..... 101/110, 70, 72, 78–83, 101/85, 88–89, 95–97, 106–108, 99–101; 235/61.9 R; 346/141, 60, 61, 98

[56] References Cited

U.S. PATENT DOCUMENTS

| | | | |
|---|---|---|---|
| 907,854 | 12/1908 | Mutschler | 101/100 |
| 1,316,175 | 9/1919 | Ohmer et al. | 346/61 X |
| 1,487,143 | 3/1924 | Brendle | 346/61 |
| 3,139,027 | 6/1964 | Norman | 101/96 |
| 3,541,955 | 11/1970 | Price | 101/108 |
| 3,701,994 | 10/1972 | Bateman | 346/60 X |
| 3,927,613 | 12/1975 | Nantz | 101/110 |

*Primary Examiner*—Edward M. Coven
*Attorney, Agent, or Firm*—Charles E. Markham

[57] ABSTRACT

A unit designating printer wheel for a counter-printer device is arranged for convenient interchangeable assembly between the drive wheel and counting printer wheels. The unit printer wheel has a plurality of unit designating characters around the rim thereof and is arranged to be locked in rotatably adjusted position; and a hub member rotatable in the unit designating printer wheel is arranged to transmit motion from the drive wheel to the counting printer wheels.

10 Claims, 16 Drawing Figures

10
14
12
16
18
20
20a
20b
21
22
24
26
28
30
34
36
38
40
46
48
50
52

5
7
8
18
22
24
36
54
56
56a
56b 23
24
32
34
37

24
34
35

6
36
54

54
64
82

44

42

COUNTING AND PRINTING MECHANISM WITH INTERCHANGEABLE UNIT PRINTER WHEEL

This invention relates generally to counter-printer devices of the type employed for recording units of flow through fluid metering devices, and more particularly to a unit designating printer wheel arranged for assembly between the drive wheel and counting printer wheels of the device.

Presently manufactured, conventional, counter-printer devices of this type intended for use in the United States and other countries employing the English unit system of measurement usually do not include a unit designating printer wheel. However, in view of the increasing use of the metric unit system in areas heretofore employing only the English unit system, it is desirable to provide a unit designating printer wheel which may be conveniently assembled in such existing devices.

It is also desirable to provide a counter-printer device for use with fluid metering devices having a unit designating printer wheel assembled on the right-hand side of the counting printer wheels, with several different unit designating characters thereon which may be selectively positioned for printing.

Accordingly, it is an object of the present invention to provide a generally new and improved counter-printer device for use with fluid flow meters, including a unit designating printer wheel located rightward of the counting printer wheels and having a plurality of different unit designating characters thereon rotatably adjustable to selectively print one of the unit designating characters.

A further object is to provide a unit designating printer wheel which may be conveniently installed in an existing counter-printer device or which may be conveniently interchanged with a unit designating printer wheel of similar construction with different unit designating characters thereon.

A further object is to provide a unit designating printer wheel for a counter-printer device mounted for rotatable adjustment on a shaft between the driving wheel and counting printer wheels and including a hub member rotatable therein for transmitting rotational movement from the driving wheel to the counting printer wheels.

A further object is to provide a conversion kit for installation in an existing counter-printer device having no unit designating printer wheel, which kit comprises a unit designating printer wheel and a companion drive wheel conveniently interchangeable, respectively, with the first existing counting printer wheel and existing drive wheel.

Further objects and advantages will appear from the following description when read in connection with the accompanying drawings, in which.

Figure 1:
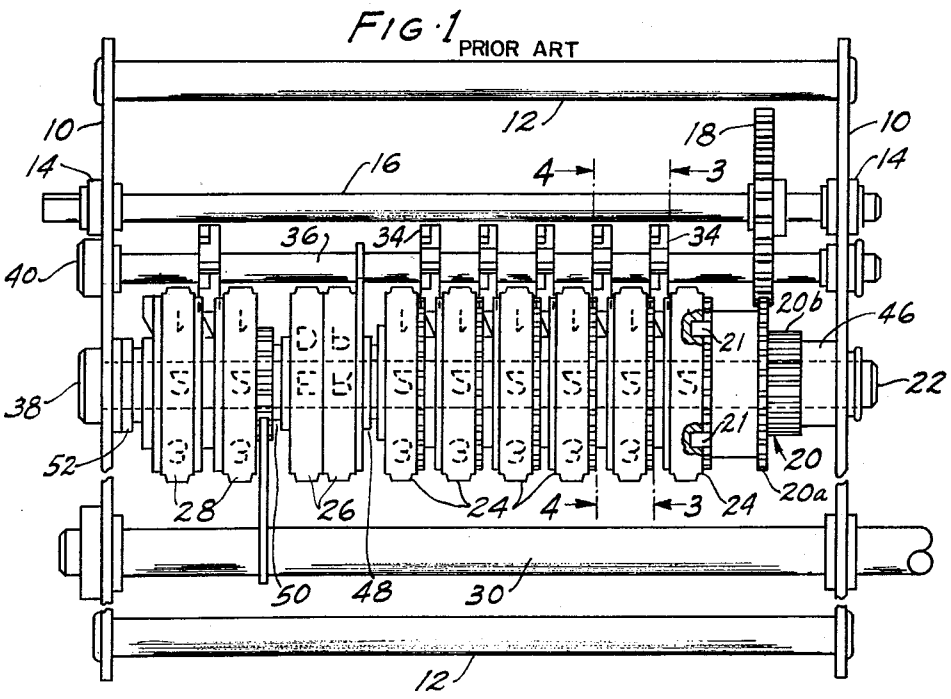
FIG. 1 PRIOR ART
FIG. 1 is a partial front elevational view of a conventional counter-printer device showing structure considered essential to a disclosure of the present invention and deleting portions thereof for the purpose of simplification.

FIG. 1 of the drawings is a part elevational view of a counter-printer device having no unit designating printer wheel. A device substantially similar to that shown in part in FIG. 1 is more completely shown and described in U.S. Pat. No. 3,139,027 to M. H. Norman. The device, as illustrated in FIG. 1, includes a frame having spaced side plates 10 and connecting spacer rods 12, which rods are secured to the side plates 10 by shouldering and riveting. Journalled in the side plates 10 in suitable journals 14 is a drive shaft 16 which carries keyed thereto a gear 18 meshed with a gear 20*a* on a drive wheel 20. The left end of drive shaft 16, projecting beyond the frame member 10, is suitably splined to receive a suitable gear (not shown) adapted to mesh with drive transmission gearing of a fluid flow metering device.

Figure 3:
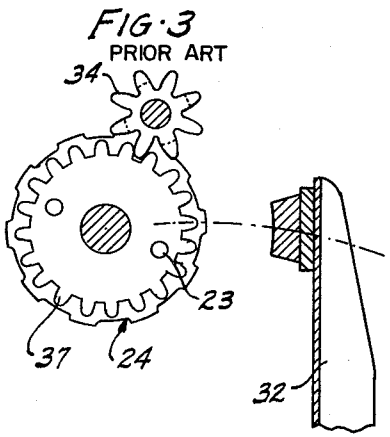
FIG. 3 PRIOR ART
FIG. 3 is a cross-sectional view taken along line 3—3 of FIG. 1, showing one face of a counting printer wheel, a transfer pinion, and a fragmentary portion of a printing hammer associated therewith.

A printer wheel shaft 22, spaced from the drive shaft 16 is supported in the side plates 10 and carries thereon the drive wheel 20 and a series of counting printer wheels 24. The drive wheel 20 and the counting printer wheels 24 are freely rotatable on printer wheel shaft 22. Conventionally, the printer wheel shaft 22 also carries, freely rotatable thereon, additional printer wheels 26 having characters thereon identifying the device on which a printer record was made and counting printer wheels 28 for recording the number of operations performed by the counter-printer device. The identifying printer wheels 26 are rotatably positioned manually and retained in position by suitable means. The counting printer wheels 28 are also suitably driven manually through a manually rotated shaft 30 journalled in side plates 10. Manual rotation of shaft 30 also effects, through spring means and cam means (not shown), the reciprocation of a printing hammer 32 shown in fragmentary association with the counter-printer wheel in FIG. 3.

Figure 4:
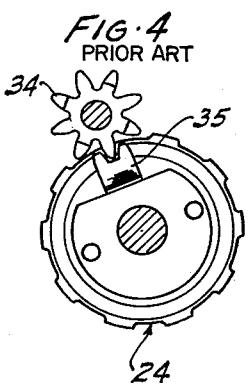
FIG. 4 PRIOR ART
FIG. 4 is a cross-sectional view taken along line 4—4 of FIG. 1, showing an opposite face view of the same counting printer wheel.

The series of counting printer wheels 24, which rotate freely on shaft 22, have numerals zero to nine thereon and are consecutively rotated at a one-to-ten ratio by Geneva drive mechanisms between adjacent wheels. Each Geneva drive mechanism includes a transfer pinion 34 mounted for rotation on a transfer pinion shaft 36, meshing with a gear 37 on one face of each counting printer wheel 24, see FIG. 3, and intermittantly meshing with a two-tooth gear element 35 on the opposite meeting face of each adjacent counting printer wheel 24, see FIG. 4. The first counting printer wheel 24 is driven directly by the drive wheel 20 through pins 21 on drive wheel 20, which enter accommodating holes 23 in one face of the counting printer wheel 24. All of the counting printer wheels 24 are provided with holes 23 so that they are interchangeable in this respect.

Figure 7:
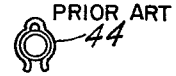
FIG. 7 PRIOR ART
FIGS. 7 and 8 are end views, respectively, of the transfer pinion shaft and printer wheel shaft, showing the spring clip means for retaining these shafts against axial movement.
Figure 8:
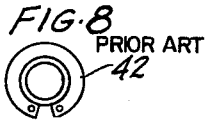
FIG. 8 PRIOR ART

The printer wheel shaft 22 and the transfer pinion shaft 36 are supported at their ends in the side plates 10 and extend through suitable holes in these plates. The left-hand end of each of the shafts 22 and 36 is headed, as indicated at 38 and 40, and the other ends of these shafts have annular grooves which receive suitable, conveniently detachable, spring retaining washers, as indicated at 42 and 44 in FIGS. 7 and 8. Removal of the spring retaining washers 42 and 44 therefore permits leftward a slidable movement of rods 22 and 36.

It will be understood that printer wheels 24, 26, and 28 and drive wheel 20 besides being freely rotatable on shaft 22 are also freely slidable thereon. The accumulated axial dimension of these printer wheels, plus any spacing members 46, 48, 50, and 52 therebetween, must closely equal the distance between side plates 10 to prevent any appreciable axial shifting. Any appreciable axial shifting of the drive wheel 20 would result in disengagement of the gear 20*a* thereon with the driving gear 18, and any appreciable shifting apart of the counting printer wheels 24 would result in disengagement of the transfer pinions 34.

Figure 2:
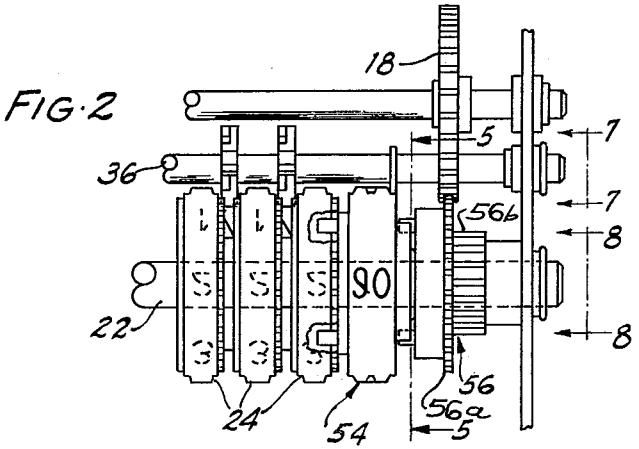
FIG. 2 is a fragmentary portion of the counter-printer device shown in FIG. 1, with a unit designating printer wheel constructed and installed therein in accordance with the present invention.

In a first embodiment of the invention, we provide a conversion kit whereby an existing counter-printer device, as illustrated in FIG. 1, may be conveniently provided with a unit designating printer wheel, generally indicated at 54 in FIG. 2, positioned between the drive wheel 20 and counting printer wheels 24. The conversion kit comprises a unit designating printer wheel assembly 54 and a drive wheel member 56, shown assembled in FIG. 2 in the positions occuppied, respectively, by the first counting printer wheel 24 and drive wheel 20 in FIG. 1. The unit designating printer wheel assembly 54 is preferably made thicker than the first counting printer wheel 24 which it replaces, and the drive wheel 56 is made sufficiently thinner than drive wheel 20, which it replaces, so that the total axial space occuppied by wheels 54 and 56 is equal to that occuppied by drive wheel 20 and the first counting printer wheel 24. The drive wheels 20 and 56 are identical except for thickness. Each includes a gear 20*a* or 56*a* arranged to mesh with gear 18, and each includes the drive pins 21. Each also includes identical sprocket wheels 20*b* and 56*b*, respectively, which cooperate with means (not shown) to effect alignment of printing characters with the printing hammer and which form no part of the present invention.

The reason the unit designating printer wheel assembly is preferably made thicker than the counter-printer wheel 24, which it replaces, is to provide a wider rim on which to form the unit designating characters. It is to be understood that, when a rim face on the unit designating printer wheel not wider than that on the counter-printer wheels 24 is deemed satisfactory to accommodate desired unit designating characters, the unit printing wheel assembly 54 may be made the same thickness as counter-printer wheels 24. In this case, it will not be necessary to replace drive wheel 20 with the thinner drive wheel 56, and the conversion kit would consist only of a unit designating printer wheel assembly 54.

Figures 9, 10, 11, 12, 13, 14, 15, 16:
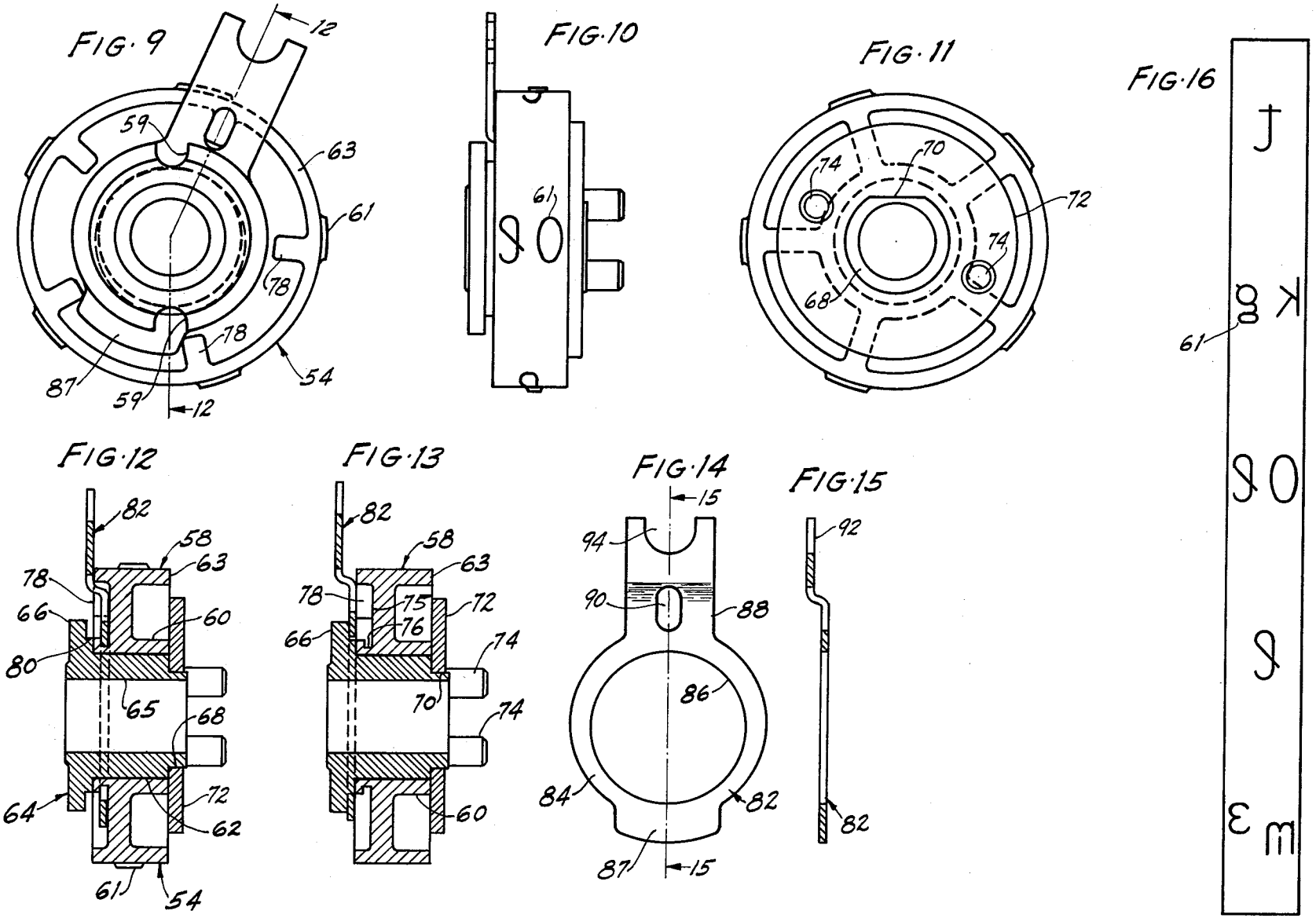
FIG. 9 is an enlarged elevational view of one face of the unit designating printer wheel assembly.
FIG. 10 is a side elevational view of the unit designating printer wheel assembly.
FIG. 11 is an opposite face view of the unit designating assembly.
FIG. 12 is a cross-sectional view of the unit designating printer wheel assembly taken along line 12—12 of FIG. 9. In this view, the wheel locking means is in a locking position.
FIG. 13 is a view similar to FIG. 12 showing the wheel locking means in a released position.
FIG. 14 is an enlarged side elevational view of the wheel locking lever.
FIG. 15 is a cross-sectional view of the locking lever taken along line 15—15 of FIG. 14.
FIG. 16 is a developed view of the rim of the unit designating pointer wheel showing typical unit designating characters circularly spaced thereon.

Referring to FIGS. 9 to 16 of the drawings, the unit designating printer wheel assembly comprises a wheel member 58 having a rim 63 with a flat peripheral surface on which five unit designating characters 61 are formed and equally spaced around the rim, as illustrated in FIG. 16. The wheel member 58 has a central hub portion 60 with a bore 62 therethrough. A driving hub member 64 has an intermediate cylindrical portion slidably received in wheel bore 62 for rotation therein and a bore 65 therethrough for receiving printer wheel shaft 22 on which it is freely rotatable. Driving hub 64 also has an exterior flange 66 at one end lying against one face of the wheel hub portion 60 and a short reduced diameter portion 68 extending outwardly from the opposite face of wheel 58.

The reduced diameter portion 68 of driving hub 64 has a flat surface 70 formed thereon, see FIG. 11, and a drive plate 72 having an accommodating, non-circular, central aperture is press fitted on the portion 68, thereby forming a second flange on that end of driving hub 64. The drive plate 72 has a pair of drive pins 74 suitably riveted therein. The pins 74 are of such diameter and projection and are so positioned that they will enter the holes 23 in one face of the adjacent counting printer wheel 24 when the unit designating printer wheel assembly is assembled on shaft 22. The arrangement in such that the hub member 64 and drive plate 72 rigidly fastened thereto rotate freely with respect to wheel 58. Referring to FIG. 9, the flange 66 of driving hub 64 is also provided with a pair of arcuate notches 59 in the rim thereof adapted to receive the pins 21 in driving wheel 56.

Referring to FIGS. 12 and 13, the left face of unit printer wheel member 58 between rim 63 and hub portion 60 is offset inwardly as indicated at 75, and there is an annular groove 76 formed in the hub portion 60 of wheel 58 near the left end thereof with one side of the groove 76 aligned with the offset face portion 75 of wheel 58. Wheel member 58 is further provided with equally spaced lugs 78 extending radially inward from the rim 63. The outer faces of lugs 78 are flush with the faces of wheel rim 63 and hub portion 60. The flange 66 of driving hub 64 has a short reduced diameter portion 80 of the same diameter as the left end of wheel hub portion 60. This short reduced diameter portion 80 provides a ledge spaced outward from the faces of rim 63 and lugs 78 for a purpose to be described.

In order to lock the wheel 58 in any position, wherein a selected one of the unit designating characters on the rim thereof is aligned for printing, a locking member 82, shown separately in FIGS. 14 and 15, is provided and inserted between flange 66 of driving hub 64 and the face of wheel member 58. Locking member 82 is formed as a stamping from sheet stock and comprises a circular central portion 84 having a circular aperture 86 therein and an arm portion 88 which extends radially upward from the circular portion 84. The arm portion 88 has an elongated aperture 90 therein adapted to receive any selected one of the lugs 78 on wheel 58. An outer end portion 92 of arm portion 88 is offset sufficiently to permit the circular portion 84 and the inner end of arm portion 88 to lie against the offset face 75 of wheel 58 and permit a part of the central circular portion 84 surrounding the aperture 86 to be entered in groove 76 in wheel hub 60 when the aperture 90 is in a position to receive a lug 78. There is also a portion 87 extending radially from the circular portion 84 of the locking member, which portion is entered between two locking lugs 78 to further strengthen the locking engagement, see FIG. 9.

Figure 5:
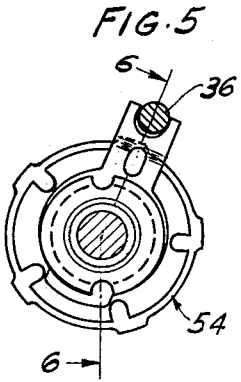
FIG. 5 is a cross-sectional view taken along line 5—5 of FIG. 2, showing one face view of the unit designating printer wheel assembly.
Figure 6:
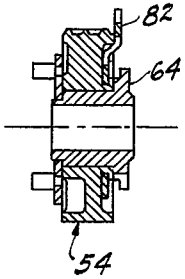
FIG. 6 is a cross-sectional view taken along line 6—6 of FIG. 5.

The circular aperture 86 of locking member 84 is slightly larger in diameter than the wheel hub portion 60 and the reduced diameter portion 80 of flange 66, thereby permitting it to be moved laterally into or out of groove 76 and axially from the groove 76 to the ledge 80. The outer end of arm portion 88 has an arcuate notch 94 therein adapted to receive the transfer pinion shaft 36, as shown in FIGS. 2 and 5. Referring to FIG. 13, the locking member 82 is shown in a released position. That is, it is resting on ledge 80 of the driving hub flange and is clear of the lugs 78 and the face of wheel 58 so that the wheel 58 may be rotated relative to locking member 82. In FIG. 12, the locking member is shown in a locking position. That is, an arcuate surface portion of the locking member defining the upper portion of circular aperture 86 is entered into groove 76, one of the lugs 78 is entered into the elongated aperture 90, and the lower portion 87 is entered between two other locking lugs 78, see FIG. 9. In this position, relative rotation of the wheel 58 and locking member 82 is prevented.

INSTALLING UNIT DESIGNATING PRINTER WHEEL IN EXISTING COUNTER-PRINTER DEVICE

To install the conversion kit described in an existing counter-printer device illustrated in FIG. 1, in the position shown in FIG. 2, the spring retaining washers 42 and 44 are first removed from the shafts 22 and 36. The shafts 22 and 36 are then slid leftward just sufficiently to remove the drive wheel 20 and the first adjacent counting printer wheel 24 from shaft 22 and to remove the rightwardmost transfer pinion 34 from shaft 36. This transfer pinion in no longer required. Deletion of one of the counting printer wheels 24 does, however, reduce the number of units which can be consecutively counted and recorded. Next, the unit designating printer wheel assembly 54 is slipped on shaft 22, with drive pins 21 on the driving plate 72 entering the holes 23 in the next adjacent counting printer wheel 24 and with the adjacent transfer pinion shaft 36 entering the groove 94 in the wheel locking member 82. Next, the thinner drive wheel 56 is slipped on shaft 22, with the drive pins 21 thereon entering the arcuate notches 59 in the flange 66 of the driving hub 64. Finally, the shafts 22 and 36 are slid rightward through the holes in plate 20 and the retaining spring washers 42 and 44 are reassembled.

Assuming the locking member 82 is in the locking position shown in FIG. 12; in order to release it so that wheel member 58 may be rotatably positioned, the arm 88 of the locking member 82 is moved laterally so as to remove the locking member from groove 76 and from engagement with lugs 78 and then axially to a position on ledge 80 as shown in FIG. 13. The depth of arcuate notch 94 in the outer end of arm 88 of locking member 82 is sufficient to permit the lateral or radial movement of the locking member, with respect to transfer pinion shaft 36, required for release of the locking member. When the locking member 82 is in released position, the wheel 58 may be rotated so that a desired character on the rim thereof is aligned with the numerals on counting printer wheels 24 in position to be printed. When wheel 58 is so positioned, the locking member 82 is again snapped into the locking position shown in FIG. 12. In the drawings, the angular dispositions of the lugs 78 relative to the angular dispositions of the unit designating characters on the rim of the wheel 58 is such that the character next succeeding a lug 78 in a clockwise direction will be in position to print when that lug is in engagement with the slotted hole 90 of locking member 82.

If it is desired to provide the counter-printer device of FIG. 1 with a unit designating printer wheel assembly similar to assembly 54, described, except that its thickness is no greater face-to-face than a counting printer wheel 24, then the substitution of a thinner drive wheel 56 for drive wheel 20 would obviously not be necessary and the use of such thinner wheel assembly is contemplated.

In a second embodiment of the invention, we provide a counter-printer device, as shown fragmentarily in FIG. 2 of the drawings, having a unit designating printer wheel assembly 54, as hereinbefore described, interposed between a drive wheel 56 of suitable thickness and the first of a series of counting printer wheels 24. It will be understood that the wheel 58 may include on the rim thereof, in circular spaced relationship, characters designating units of measure of both the English and metric systems, either of which may be selectively rotated into position for printing and locked in such position as hereinbefore described.

We claim:

1. In a counter-printer device, a frame, a printer wheel shaft mounted in said frame, a counting printer wheel rotatably mounted on said shaft and having numerical printing characters on the rim thereof, a drive wheel rotatably mounted on said shaft, and a unit designating printer wheel assembly rotatably mounted on said shaft between said drive wheel and said counting printer wheel, said assembly comprising a unit designating printer wheel having unit designating printing characters on the rim thereof and a central bore therethrough, and a driving hub member mounted for rotation in said wheel bore, said hub having a flange at each end and a central bore therethrough receiving said shaft for rotation thereon, means on the adjacent faces of said hub member and said drive wheel cooperating to form a driving connection and means on the adjacent faces of said hub member and said counting printer wheel cooperating to form a driving connection, support means adjacent the rim of said unit designating printer wheel, and releasable locking means for locking said unit designating printer wheel in a selected rotated position to said support means.

2. The device claimed in claim 1 in which said releasable locking means comprises a locking member carried by said unit designating wheel assembly, which locking member has a portion thereof in continuous engagement with said support means and another portion thereof releasably engageable with said unit designating printer wheel.

3. The device claimed in claim 1 in which said cooperating means on the adjacent faces of said hub member and said drive wheel and on the adjacent faces of said hub member and counting printer wheel forming driving connections between these members comprises drive pins on the face of one member axially entering holes in the adjacent face of another member.

4. The device claimed in claim 1 having additional counting printer wheels rotatably mounted on said printer wheel shaft and consecutively driven by means including transfer pinions rotatably mounted on a transfer pinion shaft, which pinion shaft is mounted in said frame and lies adjacent to and parallel with said printer wheel shaft; in which said unit designating printer wheel is provided with circularly spaced lugs thereon and in which said releasable locking means comprises a locking member mounted for rotation on said unit designating printer wheel assembly and having a first radially extending portion thereof provided with spaced opposed abutment surfaces engaging diametrically opposed surfaces of said transfer pinion shaft and having a second portion thereof releasably engageable with a selected one of said circularly spaced lugs on said unit designating printer wheel to prevent its rotation, and said locking member being movable with respect to said transfer pinion shaft while in engagement therewith so as to permit the engagement and disengagement of said second portion of said locking member with one of said lugs.

5. The device claimed in claim 4 in which said circularly spaced lugs project from the face of said unit designating printer wheel, are equal in number to, and have the same angular spacing about the center of said wheel as said unit designating characters on the rim thereof, and in which said second portion of said locking member is provided with a pair of opposed abutment surfaces thereon movable axially into and out of engagement with any selected one of said lugs.

6. The device claimed in claim 5 in which said unit designating printer wheel has an odd number of equally spaced unit designating printing characters on the rim thereof and the same odd number of pairs of lugs on the face thereof having the same angular spacing about the wheel center as said printing characters thereon, and in which said locking member has a third portion thereof which is moved into a locking position between two adjacent lugs when said second portion of said locking member is moved axially into locking engagement with any selected one of said lugs.

7. The device claimed in claim 5 in which said unit designating printer wheel is provided with a cylindrical hub portion having an annular locking groove therein at one end thereof, and said locking member being freely rotatable on said hub portion when moved axially so that its said second portion is moved axially out of engagement with any of said lugs and being moved into alignment with and having a portion thereof entered into a portion of said groove when moved axially so that its said second portion is moved axially into engagement with one of said lugs and then radially into said groove.

8. A unit designating printer wheel assembly for mounting on the printer wheel shaft between the drive wheel and counting printer wheels of a counter-printer device, in which device the drive wheel drives the first adjacent counting printer wheel through cooperating means on their adjacent faces forming a driving connection and, wherein, the remaining counting printer wheels are consecutively driven by means including transfer pinions mounted on a transfer pinion shaft lying adjacent to and parallel with the printer wheel shaft; said unit designating printer wheel assembly comprising a unit designating printer wheel having printing characters equally spaced on the rim thereof and a central bore therethrough, a driving hub member rotatably mounted in said wheel bore and having a flange member at each end, said hub member having a central bore therethrough for receiving said printer wheel shaft for rotation thereon, means on one of said hub flanges adapted to cooperate with said cooperating means on the adjacent face of said driving wheel to form a cooperating connection, and means on the other of said hub flanges adapted to cooperate with said driving means on the adjacent face of the adjacent counting printer wheel to form a driving connection, circularly spaced pairs of opposed abutment surfaces on said wheel equal in number to and having the same angular spacing about the wheel center as said printing characters, releasable locking means for selectively locking said wheel in a rotated position comprising a locking member rotatably mounted on said unit designating printer wheel assembly, said locking member having a first radially extending portion with a pair of opposed abutment surfaces thereon adapted to engage opposite sides of said adjacent transfer pinion shaft to prevent rotation thereof but being movable axially and radially with respect to said transfer pinion shaft while being in engagement therewith, and said locking member having a pair of abutment surfaces on a second portion thereof movable into and out of locking engagement with any selected one of said pairs of abutment surfaces on said wheel.

9. The unit designating printer-wheel assembly claimed in claim 8 in which said unit designating printer wheel has an odd number of equally spaced unit designating printing characters on the rim thereof and the same odd number of pairs of opposed abutment surfaces on the face of said wheel having the same angular spacing about said wheel center as said printing characters thereon, and in which said locking member has a third portion thereof which is moved into a locking position between the adjacent abutment surfaces of two adjoining pairs of said opposed abutment surfaces on said wheel when said second portion of said locking member is moved axially into locking engagement with any selected one of said pairs of abutment surfaces.

10. The unit designating printer wheel assembly claimed in claim 8 in which said unit designating printer wheel is provided with a cylindrical hub portion having an annular locking groove therein at one end thereof, and said locking member being freely rotatable on said hub portion when moved axially so that its said second portion is moved axially out of engagement with any of said pairs of abutment surfaces, and being moved into alignment with and having a portion thereof entered into a portion of said groove when moved axially so that its said second portion is moved axially into engagement with one of said pairs of abutments and then radially into said groove.

* * * * *